US009440103B2

(12) United States Patent
Hagge

(10) Patent No.: US 9,440,103 B2
(45) Date of Patent: Sep. 13, 2016

(54) FIRE SUPPRESSION FLOW CONTROL SYSTEM APPARATUS AND SYSTEM

(71) Applicant: KIDDE TECHNOLOGIES, INC., Wilson, NC (US)

(72) Inventor: Harlan Hagge, Knightdale, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 140 days.

(21) Appl. No.: 14/254,646

(22) Filed: Apr. 16, 2014

(65) Prior Publication Data

US 2015/0297922 A1 Oct. 22, 2015

(51) Int. Cl.

| | |
|---|---|
| ***A62C 3/00*** | (2006.01) |
| ***A62C 3/08*** | (2006.01) |
| ***A62C 35/68*** | (2006.01) |
| ***A62C 37/44*** | (2006.01) |
| ***A62C 99/00*** | (2010.01) |
| ***A62C 37/10*** | (2006.01) |

(52) U.S. Cl.

CPC ..... *A62C 3/08* (2013.01); *A62C 35/68* (2013.01); *A62C 37/10* (2013.01); *A62C 37/44* (2013.01); *A62C 99/0018* (2013.01)

(58) Field of Classification Search

CPC ..... A62C 3/08; A62C 35/68; A62C 37/10
USPC ..... 169/56, 60–62
See application file for complete search history.

(56) References Cited

U.S. PATENT DOCUMENTS

| | | | | |
|---|---|---|---|---|
| 2,497,286 A * | 2/1950 | Ashcraft | A62C 35/605 169/26 |
| 5,183,116 A * | 2/1993 | Fleming | A62C 3/08 137/501 |
| 6,702,033 B1 * | 3/2004 | Mitchell | A62C 35/023 169/85 |
| 7,434,628 B2 * | 10/2008 | Scheidt | A62C 3/08 169/16 |
| 2013/0000927 A1 * | 1/2013 | Meier | A62C 3/08 169/46 |

FOREIGN PATENT DOCUMENTS

EP 2289600 3/2011

OTHER PUBLICATIONS

Extended European Search Report dated Aug. 25, 2015 in European Application No. 15163664.4.

* cited by examiner

*Primary Examiner* — Arthur O Hall
*Assistant Examiner* — Viet Le

(57) ABSTRACT

In various embodiments, a fire suppression system includes a high rate discharge system and a low rate discharge system. The low rate discharge system may comprise components that are capable of varying mass flow of a fire suppression agent in term of the ambient conditions of the aircraft structure. In this regard, the low rate discharge system may comprise a valve that is configured to sense at least one of the ambient pressure and ambient temperature of an aircraft structure.

8 Claims, 2 Drawing Sheets

FIRE SUPPRESSION FLOW CONTROL SYSTEM APPARATUS AND SYSTEM

FIELD

The present disclosure relates to fire suppression systems, and more specifically, to flow control systems for fire suppression system that control the flow of a fire suppression agent as a function of temperature and pressure.

BACKGROUND

Fire suppression systems generally comprise a high rate discharge ("HRD") fire suppression agent system and a low rate discharge ("LRD") fire suppression agent system. Typically, LRD systems may generally be configured to deploy and/or discharge a fire suppression agent at a constant mass flow rate. In typically systems, the mass flow rate may remain constant to provide a minimum concentration of fire suppression agent at undesirable operating conditions. In this regard, typical systems may not consider actual ambient parameters such as ambient pressure and temperature during aircraft operation.

SUMMARY

In various embodiments, a fire suppression system may comprise a high rate discharge system and a low rate discharge system. The high rate discharge system may be configured to discharge a first portion of fire suppression agent to an aircraft structure. The low rate discharge system may be configured to discharge a second portion of fire suppression agent to the aircraft structure. The low rate discharge system may comprise a valve and an orifice. The valve may be configured to sense an ambient pressure of the aircraft structure. The orifice may be configured to receive a mass flow of fire suppression agent via the valve.

In various embodiments, an LRD system may comprise a bottle and a poppet valve.

The bottle may be configured to hold a pressurized fire suppression agent. The poppet valve may be in fluid communication with the bottle. The poppet valve may be configured to regulate a flow of fire suppression agent from the bottle in response to the LRD system being activated. The poppet valve may also be configured to regulate the flow of fire suppression agent as a function of ambient temperature and ambient pressure.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical changes and adaptations in design and construction may be made in accordance with this invention and the teachings herein. Thus, the detailed description herein is presented for purposes of illustration only and not of limitation. The scope of the invention is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Furthermore, any reference to singular includes plural embodiments, and any reference to more than one component or step may include a singular embodiment or step. Surface shading lines may be used throughout the figures to denote different parts but not necessarily to denote the same or different materials.

Figure 1:
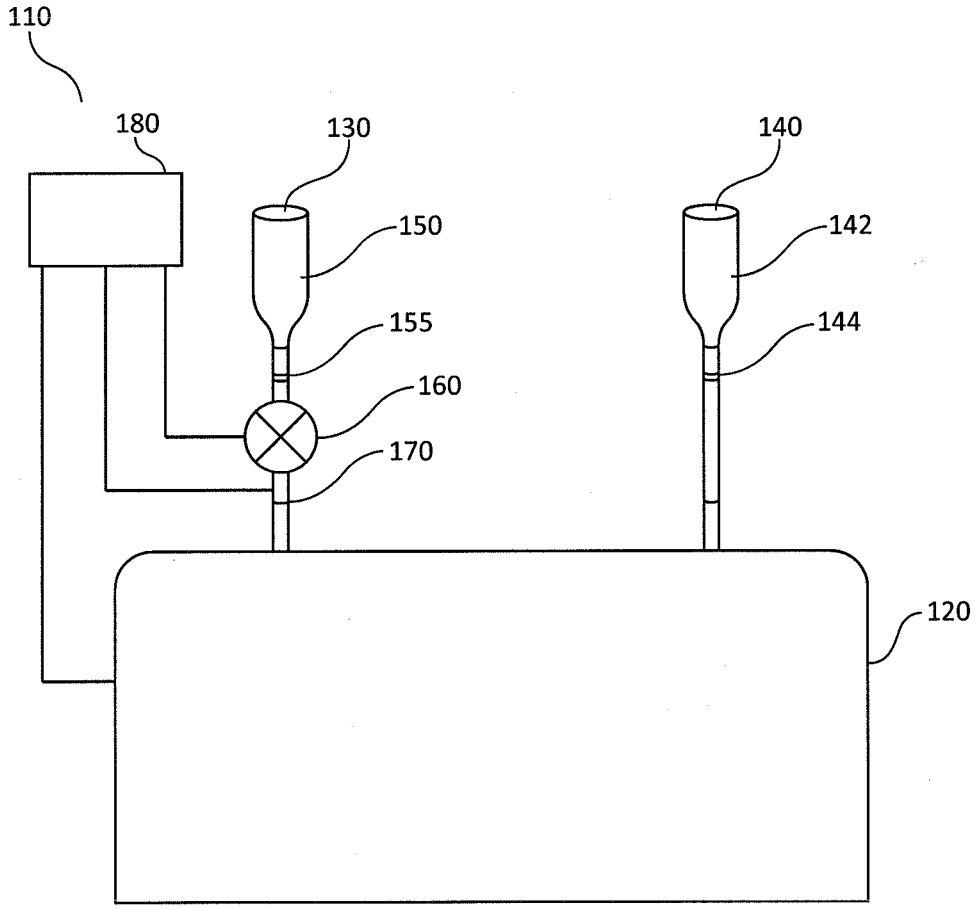
FIG. 1 is a schematic view of a fire suppression system include a control unit and a fire suppression agent flow control system, in accordance with various embodiments.

In various embodiments and with reference to FIG. 1, a fire suppression system 110 may be configured to discharge a fire suppression agent (e.g., a inert gases and/or chemical agents used to extinguish fire such as, for example, HALON®) into an aircraft structure 120. Fire suppression system 110 may consist of an HRD system 140 and an LRD system 130. HRD system 140 may comprise a bottle 142 (e.g., a pressure vessel) configured to store and/or hold a fire suppression agent. HRD system 140 may also comprise an exhaust device 144 (e.g., a flow regulating device, an orifice, a nozzle, a diffuser, and/or the like). Flow regulating device 144 may be configured to direct the discharge of a fire suppression agent deployed from bottle 142 in response to activation of HRD system 140.

In various embodiments, LRD system 130 may comprise a pressure vessel and/or bottle 150, an actuation mechanism 155, a valve 160, and an orifice 170. Bottle 150 may be configured to deploy and/or contain fire suppression agent (e.g., Halon). Actuation system 155 may be configured to contain and/or restrain the fire suppressant agent in bottle 150. Actuation system 155 may be any suitable actuation system including for example an explosive device and/or any other suitable actuation system. Moreover, actuation system 155 may create a hermetic seal that is configured to minimize and/or eliminate leakage of the fire suppressant agent contained in bottle 150. Valve 160 may be configured to receive fire suppression agent flow and regulate the flow rate, pressure, and/or other attributes of the fire suppression agent being discharged from bottle 150. Moreover, valve 160 may be configured to conduct fire suppression agent from bottle 150 to orifice 170 at a predetermined condition. This predetermined condition may vary based on atmospheric conditions such as temperature and pressure in the aircraft structure and/or exerted on LRD system 130.

In various embodiments, HRD system 140 may be configured to provide an initial knock down of a fire. In this regard, HRD portion 140 may be configured to initially mitigate, minimize, and/or limit the propagation of fire in an aircraft structure 120. LRD portion 130 may be configured to provide an extended duration of flow of fire suppression agent to maintain an agent concentration level in aircraft structure 120 that is sufficient to mitigate fire restart and/or fire propagation and compensate for the effects of airflow ventilation, leakage and/or the like that may reduce agent concentration levels in aircraft structure 120. FAA regulations may call for an LRD system to maintain volumetric fire suppression agent concentrations of at least 3% or greater (e.g., a concentration of fire suppression agent in compartment volume)

Figure 2:
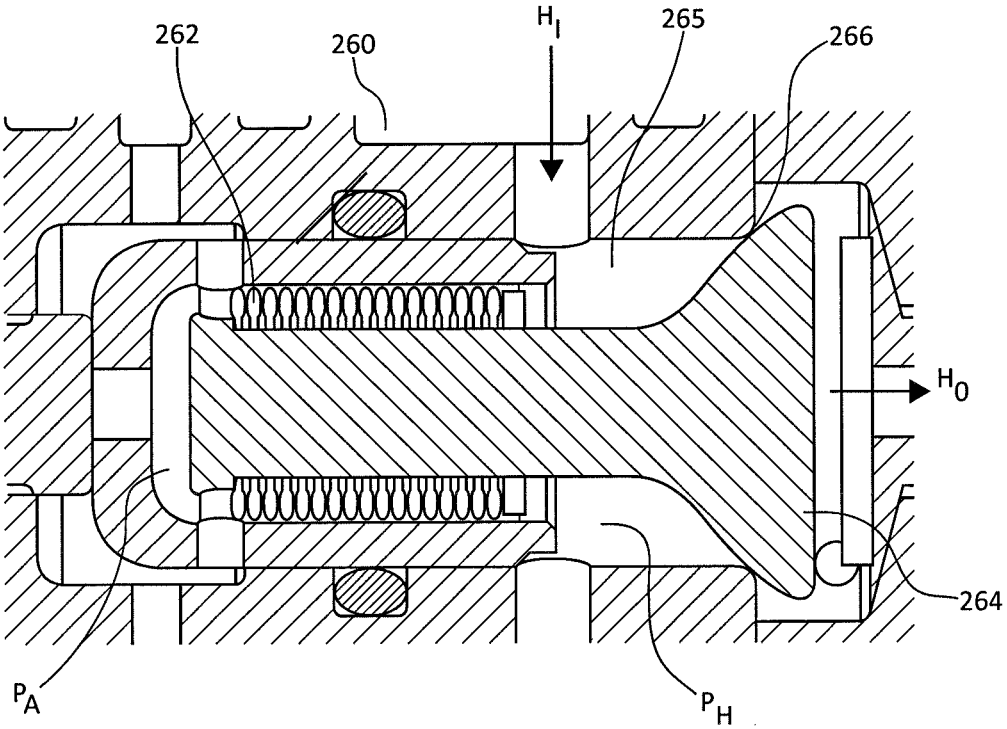
FIG. 2 illustrates a poppet valve that is a portion of a fire suppression system, in accordance with various embodiments.

In various embodiments and with reference to FIG. 2, valve 260 may be a poppet style valve. Valve 260 may comprise of bellows 262, a poppet 264, and a poppet seat 266. Valve 260 may further comprise and/or define a pressure chamber 265. Pressure chamber 265 may be configured to receive a flow suppression agent $H_I$ from the LRD system. Flow $H_I$ may be conducted into pressure chamber 265 causing the pressure in pressure chamber 265 to increase creating a force on bellows 262 causing movement of poppet 264 to close onto poppet seat 266. Low downstream pressure in the direction of $H_O$ acts upon poppet 264 to move the poppet 264 away from poppet seat 266. In this regard, $H_I$ may be configured to flow around poppet 264, past poppet seat 266 and downstream in the LRD system as flow $H_O$ to an orifice or other suitable flow control device.

In various embodiments, bellows 262 may be subjected to an ambient pressure on an outer surface of the bellows (e.g., ambient pressure=$P_A$). Moreover, an interior surface of bellows 262 may be subjected to a fire suppression agent pressure $P_H$ upstream of any metering orifice and/or device. As ambient pressure $P_A$ increases, bellows 262 may be compressed allowing poppet 264 to actuate open. In this regard, poppet 264 may move away from or translate away from poppet seat 266.

In various embodiments and with reference to FIG. 1, fire suppression system 110 may be further coupled to and/or be in electronic communication with a controller 180. Controller 180 may be configured to monitor the mass flow rate and atmospheric conditions of LRD system 130 and/or aircraft structure 120. In this regard, controller 180 may monitor the flow through valve 160 and/or orifice 170. Moreover, controller 180 may monitor the temperature and pressure at valve 160, orifice 170, and/or aircraft structure 120. Controller 180 may comprise a memory and a processor. Moreover, controller 180 may be configured to store and execute any suitable software and/or computer executable instructions.

In various embodiments, in order to achieve a concentration level of 3% or more of fire suppression agent, the mass flow rate of the fire suppression agent may need to vary. In this regard changes in air density, and/or bay pressure and temperature of aircraft structure 120 may require that different mass flow rates are needed to achieve at least a 3% fire suppression agent concentration. Concentration of a fire suppression agent may be defined by:

$$R = 0.01\left(\frac{C \times E}{S}\right),$$

where:

R=the mass flow rate of fire suppression agent (e.g., pounds per minute)

C=agent volumetric concentration in percent by volume

E=bay ventilation rate or leakage rate (e.g., volume per minute)

S=specific volume of fire suppression agent vapor (e.g., volume per mass)

In various embodiments, specific volume S of fire suppression agent $H_I$ or $H_O$ can vary based on both temperature and pressure, for example, specific volume may increase as temperature increases. Specific volume may also increase as ambient pressure decreases. As such, as specific volume increases the mass flow rate required to sustain a 3% concentration of fire suppression agent may decrease. In this regard, conditions such as high temperature and low compartment pressure of aircraft structure 120 (e.g., when aircraft structure 120 is at high altitude) may require less mass flow from LRD system 130 than when aircraft structure 120 is at a relatively low temperature and/or high compartment pressure.

In various embodiments and with reference to FIGS. 1 and 2, with proper sizing of orifice 170 located downstream of valve 160/260, it may be possible to increase the internal pressure $P_H$ acting on bellows 262. At high temperature, compressed liquefied gaseous agents have higher pressure, and as a result, at higher temperature there will be a higher internal pressure $P_H$ acting inside the bellows causing bellows 262 to further close poppet 264 against poppet seat 266. This configuration may lower the fire suppression agent flow rate. At low temperature, the fire suppression agent may be at a lower pressure and bellows 262 may open poppet 264 (e.g., translate poppet 264 away from poppet seat 266) resulting in a higher flow rate $H_O$.

Restricting the size and/or flow area of orifice 170 may provide an increased flow rate $H_O$ at cold temperatures, and decreased flow rate $H_O$ at high temperatures.

The fire extinguishing systems described herein may be deployed in any suitable aircraft structure. For example, the fire extinguishing systems described herein may be deployed and/or used in cargo bays, and other aircraft structures, as part of any suitable fire protection system in an aircraft, structure, and/or vehicle.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A fire suppression system, comprising:

a high rate discharge system configured to discharge a first portion of fire suppression agent to an aircraft structure; and a low rate discharge system configured to discharge a second portion of fire suppression agent to the aircraft structure and having:

a valve configured to sense an ambient pressure of the aircraft structure and having:

a poppet seat, a poppet configured to be actuated at least one of towards or away from the poppet seat to vary an amount of a mass flow of fire suppression agent that flows through the valve, and a bellows coupled to the poppet and having a first surface configured to be subjected to the ambient pressure of the aircraft structure and a second surface configured to be subjected to a fire suppression agent pressure of the second portion of fire suppression agent such that the bellows expands or compresses in response to a change of the ambient pressure of the aircraft structure, the expansion or compression actuating the poppet at least one of towards or away from the poppet seat to adjust the amount of the mass flow of fire suppression agent that flows through the valve, and an orifice configured to receive the mass flow of fire suppression agent via the valve.

2. The fire suppression system of claim 1, wherein the mass flow is also a function of an ambient temperature of the aircraft structure.

3. The fire suppression system of claim 1, wherein the valve further includes a pressure chamber configured to receive a flow of the second portion of fire suppression agent, the flow creating the fire suppression agent pressure.

4. The fire suppression system of claim 3, wherein the second surface of the bellows is in fluid communication with the pressure chamber.

5. The fire suppression system of claim 1, wherein the compression of the bellows actuates the poppet towards a fully open position, increasing the flow of the second portion of fire suppression agent.

6. The fire suppression system of claim 1, further comprising a controller configured to monitor at least one of an ambient temperature condition or an ambient pressure condition in the aircraft structure.

7. The fire suppression system of claim 6, wherein the controller is configured to monitor a chamber pressure within a pressure chamber of the valve.

8. The fire suppression system of claim 1, wherein at least one of a size or a flow area of the orifice is selected to achieve a desired flow rate at a desired temperature.

* * * * *